US008650826B2

(12) United States Patent
Pervan et al.

(10) Patent No.: US 8,650,826 B2
(45) Date of Patent: Feb. 18, 2014

(54) MECHANICAL LOCKING SYSTEM FOR FLOOR PANELS

(75) Inventors: Darko Pervan, Viken (SE); Tony Pervan, Stockholm (SE)

(73) Assignee: Valinge Flooring Technology AB, Viken (SE)

( * ) Notice: Subject to any disclaimer, the term of this patent is extended or adjusted under 35 U.S.C. 154(b) by 0 days.

(21) Appl. No.: 13/546,569

(22) Filed: Jul. 11, 2012

(65) Prior Publication Data

US 2013/0019555 A1 Jan. 24, 2013

Related U.S. Application Data

(60) Provisional application No. 61/509,309, filed on Jul. 19, 2011.

(51) Int. Cl.
*E04B 2/00* (2006.01)
*E04F 15/02* (2006.01)

(52) U.S. Cl.
CPC ..... *E04F 15/02* (2013.01)
USPC ..... 52/582.1

(58) Field of Classification Search
USPC ..... 52/582.1, 582.2, 586.1, 586.2, 585.1
See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |
| 634,581 | A | 10/1899 | Miller |
| 861,911 | A | 7/1907 | Stewart |
| 1,194,636 | A | 8/1916 | Joy |
| 1,723,306 | A | 8/1929 | Sipe |
| 1,743,492 | A | 1/1930 | Sipe |
| 1,809,393 | A | 6/1931 | Rockwell |
| 1,902,716 | A | 3/1933 | Newton |
| 2,026,511 | A | 12/1935 | Storm |
| 2,204,675 | A | 6/1940 | Grunert |
| 2,277,758 | A | 3/1942 | Hawkins |
| 2,430,200 | A | 11/1947 | Wilson |
| 2,497,837 | A | 2/1950 | Nelson |
| 2,596,280 | A | 5/1952 | Nystrom |
| 2,732,706 | A | 1/1956 | Friedman |

(Continued)

FOREIGN PATENT DOCUMENTS

| | | | |
|---|---|---|---|
| CA | 2456513 | A1 | 2/2003 |
| CN | 201588375 | U | 9/2010 |

(Continued)

OTHER PUBLICATIONS

U.S. Appl. No. 13/577,042, Pervan.

(Continued)

*Primary Examiner* — William Gilbert
*Assistant Examiner* — Kyle Walraed-Sullivan
(74) *Attorney, Agent, or Firm* — Buchanan Ingersoll & Rooney P.C.

(57) ABSTRACT

Floor panels are shown, which are provided with a vertical locking system on short edges having a displaceable tongue that is displaced in one direction into a tongue groove during vertical displacement of two panels.

27 Claims, 7 Drawing Sheets

(56) References Cited

U.S. PATENT DOCUMENTS 2,740,167 A 4/1956 Rowley
2,863,185 A 12/1958 Riedi
2,865,058 A 12/1958 Andersson
2,872,712 A 2/1959 Brown et al.
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,271,787 A 9/1966 Clary
3,325,585 A 6/1967 Brenneman
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,720,027 A 3/1973 Christensen
3,722,379 A 3/1973 Koester
3,742,669 A 7/1973 Mansfeld
3,760,547 A 9/1973 Brenneman
3,760,548 A 9/1973 Sauer et al.
3,778,954 A 12/1973 Meserole
3,849,235 A 11/1974 Gwynne
3,919,820 A 11/1975 Green
3,950,915 A 4/1976 Cole
4,007,994 A 2/1977 Brown
4,030,852 A 6/1977 Hein
4,037,377 A 7/1977 Howell et al.
4,064,571 A 12/1977 Phipps
4,080,086 A 3/1978 Watson
4,082,129 A 4/1978 Morelock
4,100,710 A 7/1978 Kowallik
4,107,892 A 8/1978 Bellem
4,113,399 A 9/1978 Hansen, Sr. et al.
4,169,688 A 10/1979 Toshio
4,196,554 A 4/1980 Anderson
4,227,430 A 10/1980 Jansson et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,648,165 A 3/1987 Whitehorse
5,007,222 A 4/1991 Raymond
5,071,282 A 12/1991 Brown
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,344,700 A 9/1994 McGath et al.
5,348,778 A 9/1994 Knipp et al.
5,465,546 A 11/1995 Buse
5,485,702 A 1/1996 Sholton
5,502,939 A 4/1996 Zadok et al.
5,548,937 A 8/1996 Shimonohara
5,598,682 A 2/1997 Haughian
5,618,602 A 4/1997 Nelson
5,634,309 A 6/1997 Polen
5,658,086 A 8/1997 Brokaw et al.
5,671,575 A 9/1997 Wu
5,694,730 A 12/1997 Del Rincon et al.
5,755,068 A 5/1998 Ormiston
5,899,038 A 5/1999 Stroppiana
5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,173,548 B1 1/2001 Hamar et al.
6,182,410 B1 2/2001 Pervan
6,216,409 B1 4/2001 Roy et al.
6,314,701 B1 11/2001 Meyerson
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,490,836 B1 12/2002 Moriau et al.
6,505,452 B1 1/2003 Hannig
6,553,724 B1 4/2003 Bigler
6,591,568 B1 7/2003 Pålsson
6,601,359 B2 8/2003 Olofsson
6,617,009 B1 9/2003 Chen et al.
6,647,689 B2 11/2003 Pletzer
6,647,690 B1 11/2003 Martensson
6,651,400 B1 11/2003 Murphy
6,670,019 B2 12/2003 Andersson
6,685,391 B1 2/2004 Gideon
6,763,643 B1 7/2004 Martensson
6,766,622 B1 7/2004 Thiers
6,769,219 B2 8/2004 Schwitte et al.
6,769,835 B2 8/2004 Stridsman
6,804,926 B1 10/2004 Eisermann
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,137,229 B2 11/2006 Pervan
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 11/2008 Pervan et al.
7,516,588 B2 4/2009 Pervan
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,654,055 B2 2/2010 Ricker
7,677,005 B2 3/2010 Pervan
7,716,889 B2 5/2010 Pervan
7,721,503 B2 5/2010 Pervan et al.
7,726,088 B2 * 6/2010 Muehlebach ..... 52/582.1
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,039 B2 7/2011 Groeke
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.

(56) References Cited

U.S. PATENT DOCUMENTS

| | | | |
|---|---|---|---|
| 8,302,367 | B2 | 11/2012 | Schulte |
| 8,336,272 | B2 | 12/2012 | Prager et al. |
| 8,341,914 | B2 | 1/2013 | Pervan et al. |
| 8,341,915 | B2 | 1/2013 | Pervan et al. |
| 8,353,140 | B2 | 1/2013 | Pervan et al. |
| 8,359,805 | B2 | 1/2013 | Pervan et al. |
| 8,381,477 | B2 | 2/2013 | Pervan et al. |
| 8,387,327 | B2 | 3/2013 | Pervan |
| 8,448,402 | B2 | 5/2013 | Pervan et al. |
| 2001/0024707 | A1 | 9/2001 | Andersson et al. |
| 2002/0031646 | A1 | 3/2002 | Chen et al. |
| 2002/0046433 | A1 | 4/2002 | Sellman, Jr. et al. |
| 2002/0069611 | A1 | 6/2002 | Leopolder |
| 2002/0100231 | A1 | 8/2002 | Miller et al. |
| 2002/0170258 | A1 | 11/2002 | Schwitte et al. |
| 2002/0170259 | A1 | 11/2002 | Ferris |
| 2002/0178674 | A1 | 12/2002 | Pervan |
| 2002/0178680 | A1 | 12/2002 | Martensson |
| 2003/0009971 | A1 | 1/2003 | Palmberg |
| 2003/0024199 | A1 | 2/2003 | Pervan et al. |
| 2003/0037504 | A1 | 2/2003 | Schwitte et al. |
| 2003/0084636 | A1 | 5/2003 | Pervan |
| 2003/0094230 | A1 | 5/2003 | Sjoberg |
| 2003/0101681 | A1 | 6/2003 | Tychsen |
| 2003/0154676 | A1 | 8/2003 | Schwartz |
| 2003/0180091 | A1 | 9/2003 | Stridsman |
| 2003/0188504 | A1 | 10/2003 | Ralf |
| 2003/0196405 | A1 | 10/2003 | Pervan |
| 2004/0031227 | A1 | 2/2004 | Knauseder |
| 2004/0049999 | A1 | 3/2004 | Krieger |
| 2004/0060255 | A1 | 4/2004 | Knauseder |
| 2004/0068954 | A1 | 4/2004 | Martensson |
| 2004/0107659 | A1 | 6/2004 | Glockl |
| 2004/0123548 | A1 | 7/2004 | Gimpel et al. |
| 2004/0128934 | A1 | 7/2004 | Hecht |
| 2004/0139676 | A1 | 7/2004 | Knauseder |
| 2004/0139678 | A1 | 7/2004 | Pervan |
| 2004/0159066 | A1 | 8/2004 | Thiers et al. |
| 2004/0168392 | A1 | 9/2004 | Konzelmann et al. |
| 2004/0177584 | A1 | 9/2004 | Pervan |
| 2004/0182033 | A1 | 9/2004 | Wernersson |
| 2004/0182036 | A1 | 9/2004 | Sjoberg et al. |
| 2004/0200175 | A1 | 10/2004 | Weber |
| 2004/0211143 | A1 | 10/2004 | Hannig |
| 2004/0250492 | A1 | 12/2004 | Becker |
| 2004/0255541 | A1 | 12/2004 | Thiers |
| 2004/0261348 | A1 | 12/2004 | Vulin |
| 2005/0028474 | A1 | 2/2005 | Kim |
| 2005/0050827 | A1 | 3/2005 | Schitter |
| 2005/0138881 | A1 | 6/2005 | Pervan |
| 2005/0160694 | A1 | 7/2005 | Pervan |
| 2005/0166514 | A1 | 8/2005 | Pervan |
| 2005/0205161 | A1 | 9/2005 | Lewark |
| 2005/0210810 | A1 | 9/2005 | Pervan |
| 2005/0235593 | A1 | 10/2005 | Hecht |
| 2006/0070333 | A1 | 4/2006 | Pervan |
| 2006/0099386 | A1 | 5/2006 | Smith |
| 2006/0101769 | A1 | 5/2006 | Pervan et al. |
| 2006/0156670 | A1 | 7/2006 | Knauseder |
| 2006/0236642 | A1 | 10/2006 | Pervan |
| 2006/0260254 | A1 | 11/2006 | Pervan |
| 2007/0006543 | A1 | 1/2007 | Engstrom |
| 2007/0028547 | A1* | 2/2007 | Grafenauer et al. ..... 52/586.1 |
| 2007/0065293 | A1 | 3/2007 | Hannig |
| 2007/0108679 | A1 | 5/2007 | Grothaus |
| 2007/0151189 | A1 | 7/2007 | Yang et al. |
| 2007/0175143 | A1 | 8/2007 | Pervan et al. |
| 2007/0175156 | A1 | 8/2007 | Pervan et al. |
| 2007/0193178 | A1 | 8/2007 | Groeke et al. |
| 2007/0209736 | A1 | 9/2007 | Deringor et al. |
| 2008/0000185 | A1 | 1/2008 | Duernberger |
| 2008/0005989 | A1 | 1/2008 | Pervan et al. |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0034708 | A1 | 2/2008 | Pervan |
| 2008/0041008 | A1 | 2/2008 | Pervan |
| 2008/0066415 | A1 | 3/2008 | Pervan |
| 2008/0104921 | A1 | 5/2008 | Pervan et al. |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0155930 | A1 | 7/2008 | Pervan et al. |
| 2008/0172971 | A1 | 7/2008 | Pervan |
| 2008/0216434 | A1 | 9/2008 | Pervan |
| 2008/0216920 | A1 | 9/2008 | Pervan |
| 2008/0236088 | A1 | 10/2008 | Hannig et al. |
| 2008/0263975 | A1 | 10/2008 | Mead |
| 2008/0295432 | A1 | 12/2008 | Pervan et al. |
| 2009/0019806 | A1 | 1/2009 | Muehlebach |
| 2009/0100782 | A1* | 4/2009 | Groeke et al. ..... 52/589.1 |
| 2009/0133353 | A1 | 5/2009 | Pervan et al. |
| 2009/0151290 | A1 | 6/2009 | Liu |
| 2009/0155612 | A1 | 6/2009 | Pervan et al. |
| 2009/0193741 | A1 | 8/2009 | Cappelle |
| 2009/0193748 | A1 | 8/2009 | Boo et al. |
| 2009/0193753 | A1 | 8/2009 | Schitter |
| 2009/0308014 | A1 | 12/2009 | Muehlebach |
| 2010/0043333 | A1 | 2/2010 | Hannig et al. |
| 2010/0083603 | A1 | 4/2010 | Goodwin |
| 2010/0173122 | A1 | 7/2010 | Susnjara |
| 2010/0281803 | A1 | 11/2010 | Cappelle |
| 2010/0293879 | A1 | 11/2010 | Pervan et al. |
| 2010/0300030 | A1 | 12/2010 | Pervan et al. |
| 2010/0300031 | A1 | 12/2010 | Pervan et al. |
| 2010/0319291 | A1 | 12/2010 | Pervan et al. |
| 2011/0016815 | A1 | 1/2011 | Yang |
| 2011/0030303 | A1 | 2/2011 | Pervan et al. |
| 2011/0041996 | A1 | 2/2011 | Pervan |
| 2011/0088344 | A1 | 4/2011 | Pervan et al. |
| 2011/0088345 | A1 | 4/2011 | Pervan |
| 2011/0131916 | A1 | 6/2011 | Chen |
| 2011/0154763 | A1 | 6/2011 | Bergelin et al. |
| 2011/0167750 | A1 | 7/2011 | Pervan |
| 2011/0167751 | A1* | 7/2011 | Engstrom ..... 52/588.1 |
| 2011/0197535 | A1 | 8/2011 | Baker et al. |
| 2011/0225922 | A1 | 9/2011 | Pervan et al. |
| 2011/0252733 | A1 | 10/2011 | Pervan |
| 2011/0271632 | A1* | 11/2011 | Cappelle et al. ..... 52/582.2 |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0124932 | A1 | 5/2012 | Schulte et al. |
| 2012/0151865 | A1 | 6/2012 | Pervan et al. |
| 2012/0174515 | A1 | 7/2012 | Pervan |
| 2012/0174520 | A1 | 7/2012 | Pervan |
| 2012/0174521 | A1 | 7/2012 | Schulte et al. |
| 2012/0192521 | A1 | 8/2012 | Schulte |
| 2012/0279161 | A1 | 11/2012 | Håkansson et al. |
| 2013/0008117 | A1 | 1/2013 | Pervan |
| 2013/0014463 | A1 | 1/2013 | Pervan |
| 2013/0042562 | A1 | 2/2013 | Pervan |
| 2013/0042563 | A1 | 2/2013 | Pervan |
| 2013/0042564 | A1 | 2/2013 | Pervan |
| 2013/0042565 | A1 | 2/2013 | Pervan |
| 2013/0055950 | A1 | 3/2013 | Pervan et al. |
| 2013/0081349 | A1 | 4/2013 | Pervan et al. |
| 2013/0111845 | A1 | 5/2013 | Pervan |
| 2013/0145708 | A1 | 6/2013 | Pervan |

FOREIGN PATENT DOCUMENTS

| | | | |
|---|---|---|---|
| DD | 10 2007 018 309 | A1 | 8/2008 |
| DE | 39 32 980 | A1 | 11/1991 |
| DE | 299 22 649 | U1 | 4/2000 |
| DE | 199 40 837 | A1 | 11/2000 |
| DE | 199 58 225 | A1 | 6/2001 |
| DE | 202 06 460 | U1 | 7/2002 |
| DE | 202 05 774 | U1 | 8/2002 |
| DE | 203 20 799 | U1 | 4/2005 |
| DE | 10 2004 055 951 | A1 | 7/2005 |
| DE | 10 2004 001 363 | A1 | 8/2005 |
| DE | 10 2004 054 368 | A1 | 5/2006 |

(56) References Cited

FOREIGN PATENT DOCUMENTS

| | | | |
|---|---|---|---|
| DE | 10 2005 024 366 | A1 | 11/2006 |
| DE | 10 2006 024 184 | A1 | 11/2007 |
| DE | 10 2006 037 614 | B3 | 12/2007 |
| DE | 10 2006 057 491 | A | 6/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 048 050 | B3 | 1/2011 |
| EP | 0 013 852 | A1 | 8/1980 |
| EP | 0 871 156 | A2 | 10/1998 |
| EP | 0 974 713 | A1 | 1/2000 |
| EP | 1 308 577 | A2 | 5/2003 |
| EP | 1 350 904 | A2 | 10/2003 |
| EP | 1 350 904 | A3 | 10/2003 |
| EP | 1 357 239 | A2 | 10/2003 |
| EP | 1 357 239 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 017 403 | A2 | 1/2009 |
| EP | 2 570 564 | A2 | 3/2013 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-288017 | A | 10/1994 |
| JP | 6-306961 | A | 11/1994 |
| JP | 6-322848 | A | 11/1994 |
| JP | 7-300979 | A | 11/1995 |
| JP | 8-086080 | A | 4/1996 |
| WO | WO 94/26999 | A1 | 11/1994 |
| WO | WO 97/47834 | A1 | 12/1997 |
| WO | WO 98/22677 | A1 | 5/1998 |
| WO | WO 00/20705 | A1 | 4/2000 |
| WO | WO 00/43281 | A1 | 7/2000 |
| WO | WO 00/47841 | A1 | 8/2000 |
| WO | WO 00/55067 | A1 | 9/2000 |
| WO | WO 01/02670 | A1 | 1/2001 |
| WO | WO 01/02672 | A1 | 1/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/98604 | A1 | 12/2001 |
| WO | WO 02/48127 | | 6/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/078761 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/053257 | A1 | 6/2004 |
| WO | WO 2004/053257 | A8 | 6/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/054599 | A1 | 9/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2007/015669 | A2 | 2/2007 |
| WO | WO 2007/079845 | A1 | 7/2007 |
| WO | WO 2007/089186 | A1 | 8/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2009/116926 | A1 | 9/2009 |
| WO | WO 2010/070472 | A2 | 6/2010 |
| WO | WO 2010/070605 | A2 | 6/2010 |
| WO | WO 2010/087752 | A1 | 8/2010 |
| WO | WO 2010/108980 | A1 | 9/2010 |
| WO | WO 2010136171 | A1 * | 12/2010 ..... E04F 15/02 |
| WO | WO 2011/001326 | A2 | 1/2011 |
| WO | WO 2011/012104 | A2 | 2/2011 |
| WO | WO 2011/032540 | A2 | 3/2011 |
| WO | WO 2011/127981 | A1 | 10/2011 |
| WO | WO 2011/151758 | A2 | 12/2011 |

OTHER PUBLICATIONS

U.S. Appl. No. 13/540,107, Pervan.
U.S. Appl. No. 13/544,281, Pervan.
U.S. Appl. No. 13/585,204, Pervan.
U.S. Appl. No. 13/585,485, Pervan.
U.S. Appl. No. 13/585,179, Pervan.
U.S. Appl. No. 13/596,988, Pervan.
U.S. Appl. No. 13/660,538, Pervan.
U.S. Appl. No. 13/670,039, Pervan.
U.S. Appl. No. 13/728,121, Pervan.
U.S. Appl. No. 61/620,233, Boo.
U.S. Appl. No. 61/620,246, Boo.

Pervan, Darko, et al., U.S. Appl. No. 13/577,042, entitled "Mechanical Locking System for Floor Panels," filed Aug. 3, 2012.

Pervan, Darko, U.S. Appl. No. 13/540,107, entitled "Mechanical Locking of Floor Panels with a Glued Tongue," filed Jul. 2, 2012.

Pervan, Darko, U.S. Appl. No. 13/544,281, entitled "Mechanical Locking System for Floor Panels," filed Jul. 9, 2012.

Pervan, Darko, et al., U.S. Appl. No. 13/585,204, entitled "Mechanical Locking System for Floor Panels," filed Aug. 14, 2012.

Pervan, Darko, et al., U.S. Appl. No. 13/585,485, entitled "Mechanical Locking System for Floor Panels," filed Aug. 14, 2012.

Pervan, Darko, et al., U.S. Appl. No. 13/585,179, entitled, "Mechanical Locking System for Floor Panels," filed Aug. 14, 2012.

Pervan, Darko, et al., U.S. Appl. No. 13/596,988, entitled, "Mechanical Locking System for Floor Panels," filed Aug. 28, 2012.

Pervan, Darko, et al., U.S. Appl. No. 13/660,538, entitled "Mechanical Locking of Floor Panels with Vertical Snap Folding," filed Oct. 25, 2012.

Pervan, Darko, et al., U.S. Appl. No. 13/670,039, entitled "Mechanical Locking of Floor Panels with a Flexible Tongue," filed Nov. 6, 2012.

Pervan, Darko, et al., U.S. Appl. No. 13/728,121, entitled "Mechanical Locking of Floor Panels with a Flexible Tongue," filed Dec. 27, 2012.

Boo, Christian, U.S. Appl. No. 61/620,233, entitled "Building Panel with a Mechanical Locking System," filed Apr. 4, 2012.

Boo, Christian, U.S. Appl. No. 61/620,246, entitled "Method for Producing a Mechanical Locking System for Building Panels," filed Apr. 4, 2012.

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Engstrand, Ola (Contact)/Välinge Innovation AB, Technical Disclosure entitled "VA-038 Mechanical Locking of Floor Panels With Vertical Folding," IP.com No. IPCOM000179246D, Feb. 10, 2009, IP.com Prior Art Database, 59 pages.

(56) References Cited

OTHER PUBLICATIONS

Engstrand, Ola (Contact)/Välinge Innovation AB, Technical Disclosure entitled "VA043 5G Linear Slide Tongue," IP.com No. IPCOM000179015D, Feb. 4, 2009, IP.com Prior Art Database, 126 pages.
Engstrand, Ola (Owner)/Välinge Innovation AB, Technical Disclosure entitled "VA043b PCT Mechanical Locking of Floor Panels," IP.com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP.com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP.com No. IPCOM000203832D, Feb. 4, 2011, IP.com Prior Art Database, 22 pages.
Pervan, Darko (Author)/Välinge Flooring Technology, Technical Disclosure entitled "VA066b Glued Tongue," IP.com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP.com No. IPCOM000208542D, Jul. 12, 2011, IP.com Prior Art Database, 37 pages.
Pervan, Dark (Author)/Välinge Flooring Technology, Technical Disclosure entitled "VA068 Press Lock VFT" IP.com No. IPCOM000208854D, Jul. 20, 2011, IP.com Prior Art Database, 25 pages.
Pervan, Darko (Author), Technical Disclosure entitled "VA069 Combi Tongue," IP.com No. IPCOM000210866D, Sep. 13, 2011, IP.com Prior Art Database, 41 pages.
Pervan, Dark (Author), Technical Disclosure entitled "VA070 Strip Part," IP.com No. IPCOM000210867D, Sep. 13, 2011, IP.com Prior Art Database, 43 pages.
Pervan, Darko (Author), Technical Disclosure entitled "VA071 Pull Lock," IP.com No. IPCOM000210868D, Sep. 13, 2011, IP.com Prior Art Database, 22 pages.
Pervan, Dark (Author), Technical Disclosure entitled "VA073a Zip Loc," IP.com No. IPCOM000210869D, Sep. 13, 2011, IP.com Prior Art Database, 36 pages.
U.S. Appl. No. 13/758,603, Pervan, et al.
Pervan, Darko, et al., U.S. Appl. No. 13/758,603, entitled "Mechanical Locking System for Panels and Method of Installing Same," filed Feb. 4, 2013.
U.S. Appl. No. 13/886,916, Pervan et al.
Pervan, Darko, et al., U.S. Appl. No. 13/886,916, entitled "Mechanical Locking of Building Panels," filed May 3, 2013.
U.S. Appl. No. 13/855,966, Boo.
U.S. Appl. No. 13/855,979, Boo et al.
Boo, Christian, U.S. Appl. No. 13/855,966, entitled "Building Panel with a Mechanical Locking System," filed Apr. 3, 2013.
Boo, Christian, et al., U.S. Appl. No. 13/855,979, entitled "Method for Producing a Mechanical Locking System for Building Panels," filed Apr. 3, 2013.
International Search Report mailed Oct. 15, 2012 in PCT/SE2012/050828, Swedish Patent Office, Stockholm, Sweden, 7 pages.
Pervan, Darko, et al., U.S. Appl. No. 13/962,446 entitled "Mechanical Locking System for Floor Panels," filed in the U.S. Patent and Trademark Office on Aug. 8, 2013.
Pervan, Darko, U.S. Appl. No. 14/011,042 entitled "Mechanical Locking System for Floor Panels," filed in the U.S. Patent and Trademark Office on Aug. 27, 2013.
Pervan, Darko, et al., U.S. Appl. No. 14/011,121 entitled "Mechanical Locking System for Floor Panels with Vertical Snap Folding," filed in the U.S. Patent and Trademark Office on Aug. 27, 2013.
Correspondence from German Patent and Trademark Office to GrOnecker, Kinkeldey, Stockmair & Schwanhäusse forwarding cancellation request, Nov. 11, 2013, 2 pages.
*Cancellation Request by Spanolux N.V. Divisie Balterio, lnhaberin: Välinge Flooring Technology AB, Antragstellerin: Spanolux N.V. Divisie Balterio*, Oct. 13, 2013, 75 pages, Bird & Bird LLP, Dusseldorf, DE.
Pervan, Darko, U.S. Appl. No. 14/080,105 entitled "Mechanical Locking of Floor Panels with Vertical Folding," filed in the U.S. Patent and Trademark Office on Nov. 14, 2013.
Correspondence from German Patent and Trademark Office to Gainecker, Kinkeldey, Stockmair & Schwanhausse forwarding cancellation request, Nov. 11, 2013, 2 pages.
*Cancellation Request by Spanolux N.V. Divisie Balterio, lnhaberin: Välinge Flooring Technology AB, Antragstelierin: Spanolux N.V. Divisie Balterio*, Oct. 13, 2013, 75 pages, Bird & Bird LLP, Dusseldorf, DE.
*Complaint by Välinge Flooring Technology AB, Välinge Flooring Technology AB gegen Spanolux N.V. Divisie Balterio*, Jan. 7, 2013, 144 pages, Grunecker Patent—und Rechtsanwalte, Munchen, DE (with machine translation of Complaint, and with Attachments ("Anlage"): Anlage K1, Anlage K 2, Anlage 2a, Anlage K3, Anlage K4, Anlage K5, Anlage K6, Anlage K7 and Anlage K9).
*Court Order, Verfiigung im Rechtsstreit Välinge Flooring gegen Spanolux N.V.*, Jan. 9, 2013, 2 pages, Landgericht Mannheim, Mannheim, DE.
*Reply by Spanolux N.V. Divisie Balterio, Välinge Flooring Technology AB gegen Spanolux N.V. Divisie Balterio*, Mar. 12, 2013, 675 pages, Bird & Bird LLP, Dusseldorf, DE (with machine translation of Reply; and with Attachments ("Anlage"): Anlage B1, Anlage B2, Anlage B3, Anlage B4, Anlage B5, Anlage B7, Anlage B8, Anlage B9, Anlage B10, Anlage B11, Anlage B12, Anlage B13, Anlage B14, Anlage B15, Anlage B16, Anlage B17, Anlage B18, Anlage B18a, Anlage B19, Anlage B20, Anlage B21, Anlage B21a, Anlage B22, Anlage B22a, Anlage B23, Anlage B23a, Anlage B24, Anlage B25, Anlage B26, Anlage B26a, Anlage B27, Anlage B28, Anlage B29, Anlage B30, Anlage B31, Anlage B32, Anlage B33, Anlage B34, Anlage B35 and Anlage B36).
*Reply by Välinge Flooring Technology AB, Välinge Flooring Technology AB gegen Spanolux N.V. Divisie Balterio*, Jul. 3, 2013, 107 pages, Grunecker Patent—und Rechtsanwalte, München, DE (with machine translation of Reply, and with Attachments ("Anlage"): Anlage K10, Anlage Kl0a, Anlage K11, Anlage K12, Anlage K13, Anlage K14, Anlage K15, Anlage K16, Anlage K16a and Anlage K17).
*Reply by Spanolux N.V. Divisie Balterio, Välinge Flooring Technology AB gegen Spanolux N.V. Divisie Balterio*, Sep. 17 2013, 833 pages, Bird & Bird LLP, Düsseldorf, DE (with machine translation of Reply; and with Attachments ("Anlage"): Anlage B37, Anlage B38, Anlage B39, Anlage B40, Anlage B43, Anlage B44, Anlage B45, Anlage B45a, Anlage B46, Anlage B47, Anlage B56, Anlage B58, Anlage B59, Anlage B60, Anlage B83, Anlage B85, Anlage B85a, Anlage B85b, Anlage B85c, Anlage B86, Anlage B87 and Anlage B18b, Anlage B25b, Anlage B26b, Anlage B41, Anlage B42, Anlage B48, Anlage B49, Anlage B49a, Anlage B50, Anlage B51, Anlage B52, Anlage B53, Anlage B54, Anlage B55, Anlage B57, Anlage B61, Anlage B62, Anlage B63, Anlage B63a, Anlage B64, Anlage B65, Anlage B66, Anlage B67, Anlage B68,Anlage B69, Anlage B70, Anlage B71, Anlage B72, Anlage B72a, Anlage B73, Anlage B74, Anlage B75, Anlage B75a, Anlage B76, Anlage B77, Anlage B78, Anlage B79,.
*Reply by Välinge Flooring Technology AB, Välinge Flooring Technology AB gegen Spanolux N.V. Divisie Balterio*, Sep. 23, 2013, 41 pages, Grünecker Patent —and Rechtsanwälte, München, DE (with machine translation of Reply).
"Balterio introduces the new fold down installation system PXP®." News [online]. Balterio Corporation, 2011 [retrieved on Jul. 11, 2013 ]. Retrieved from the Internet: <URL:http://www.balterio.com/gb/en/news/359 >.
Spanolux N.V.—DIV. Balterio, Priority Document for EP 11007573, Sep. 16, 2011, 20 pages, European Patent Office.
Pervan, Darko, U.S. Appl. No. 14/042,887 entitled "Mechanical Locking of Floor Panels with a Glued Tongue," filed in the U.S. Patent and Trademark Office on Oct. 1, 2013.

(56) References Cited

OTHER PUBLICATIONS

Pervan, Darko, et al., U.S. Appl. No. 14/046,235 entitled "Mechanical Locking of Floor Panels with a Flexible Tongue," filed in the U.S. Patent and Trademark Office on Oct. 4, 2013.
Nygren, Per, et al., U.S. Appl. No. 61/774,749, entitled "Building Panels Provided with a Mechanical Locking System," filed in the U.S. Patent and Trademark Office on Mar. 8, 2013.
(Human) English-language translation of paragraphs 211-214 of *Reply by Spanolux N.V. Divisie Balterio, Välinge Flooring Technology AB gegen Spanolux N.V. Divisie Balterio*, Bird & Bird LLP, Düsseldorf, DE.
Pervan, Darko, et al., U.S. Appl. No. 14/095,052, entitled "Mechanical Locking of Floor Panels," filed in the U.S. Patent and Trademark Office on Dec. 3, 2013.

* cited by examiner

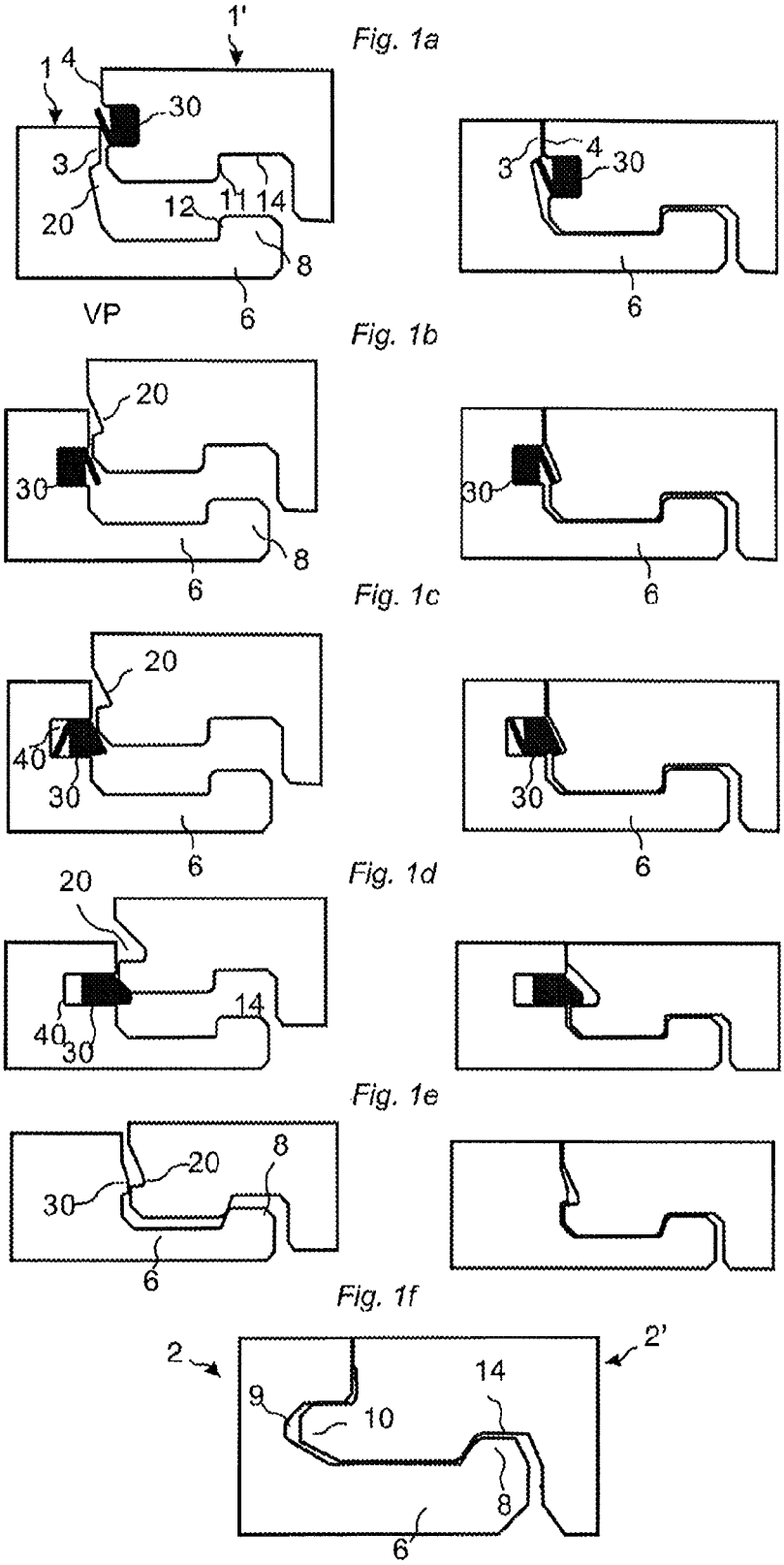
PRIOR ART

MECHANICAL LOCKING SYSTEM FOR FLOOR PANELS

CROSS REFERENCE TO RELATED APPLICATIONS

The present application claims the benefit of U.S. Ser. No. 61/509,309, which was filed on Jul. 19, 2011, and the entire contents of which are incorporated herein by reference.

TECHNICAL FIELD

The disclosure generally relates to the field of mechanical locking systems for floor panels and building panels. The disclosure shows floorboards, locking systems, installation methods and production methods.

FIELD OF APPLICATION

The present disclosure is particularly suitable for use in floating floors, which are formed of floor panels which are joined mechanically with a locking system integrated with the floor panel, i.e. mounted at the factory, are made up of one or more upper layers of veneer, decorative laminate powder based surfaces or decorative plastic material, an intermediate core of wood-fibre-based material or plastic material and preferably a lower balancing layer on the rear side of the core.

The following description of known technique, problems of known systems and objects and features of the disclosure will therefore, as a non-restrictive example, be aimed above all at this field of application and in particular at panels formed as rectangular floor panels with long and shorts edges intended to be mechanically joined to each other on both long and short edges.

The long and short edges are mainly used to simplify the description of the disclosure. The panels may be square. The disclosure is preferably used on the short edges. It should be emphasised that the disclosure may be used in any floor panel and it may be combined with all types of known locking system formed on the long edges, where the floor panels are intended to be joined using a mechanical locking system connecting the panels in the horizontal and vertical directions on at least two adjacent sides.

The disclosure may also be applicable to, for instance, solid wooden floors, parquet floors with a core of wood or wood-fibre-based material and a surface of wood or wood veneer and the like, floors with a printed and preferably also varnished surface, floors with a surface layer of plastic or cork, linoleum, rubber. Even floors with hard surfaces such as stone, tile and similar materials are included and floorings with soft wear layer, for instance needle felt glued to a board. The disclosure may also be used for joining building panels which preferably contain a board material for instance wall panels, ceilings, furniture components and similar.

BACKGROUND

Laminate flooring usually comprises a core of a 6-12 mm fibre board, a 0.2-0.8 mm thick upper decorative surface layer of laminate and a 0.1-0.6 mm thick lower balancing layer of laminate, plastic, paper or like material. A laminate surface comprises melamine-impregnated paper. The most common core material is fibreboard with high density and good stability usually called HDF—High Density Fibreboard. Sometimes also MDF—Medium Density Fibreboard—is used as core.

Traditional laminate floor panels of this type have been joined by means of glued tongue-and-groove joints. In addition to such traditional floors, floor panels have been developed which do not require the use of glue and instead are joined mechanically by means of so-called mechanical locking systems. These systems comprise locking means, which lock the panels horizontally and vertically. The mechanical locking systems are usually formed by machining of the core of the panel. Alternatively, parts of the locking system may be formed of a separate material, for instance aluminium or HDF, which is integrated with the floor panel, i.e. joined with the floor panel in connection with the manufacture thereof.

The main advantages of floating floors with mechanical locking systems are that they are easy to install. They may also easily be taken up again and used once more at a different location.

Definition of Some Terms

In the following text, the visible surface of the installed floor panel is called "front side", while the opposite side of the floor panel, facing the sub floor, is called "rear side". The edge between the front and rear side is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane. By "vertical locking" is meant locking parallel to the vertical plane in D1 direction. By "horizontal locking" is meant locking parallel to the horizontal plane in D2 direction.

By "up" is meant towards the front side, by "down" towards the rear side, by "inwardly" mainly horizontally towards an inner and centre part of the panel and by "outwardly" mainly horizontally away from the centre part of the panel.

By "locking systems" are meant co acting connecting elements, which connect the floor panels vertically and/or horizontally.

Related Art and Problems Thereof

For mechanical joining of long edges as well as short edges in the vertical and in the first horizontal direction perpendicular several methods may be used. One of the most used methods is the angle-snap method. The long edges are installed by angling. The panel is than displaced in locked position along the long side. The short edges are locked by horizontal snapping. The vertical connection is generally a tongue and a groove. During the horizontal displacement, a strip with a locking element is bent and when the edges are in contact, the strip springs back and a locking element enters a locking groove and locks the panels horizontally. Such a snap connection is complicated since a hammer and a tapping block may need to be used to overcome the friction between the long edges and to bend the strip during the snapping action.

Similar locking systems may also be produced with a rigid strip and they are connected with an angling-angling method where both short and long edges are angled into a locked position.

Recently new and very efficient locking systems have been introduced with a separate flexible or displaceable integrated tongue on the short edge that allows installation with only an angling action, generally referred to as "vertical folding". Such a system is described in WO 2006/043893 (Välinge Innovation AB).

Several versions are used on the market as shown in FIGS. 1*a*-1*f*. FIG. 1*a*, 1*b* show a flexible tongue 30 with a flexible snap tab extending from the edge. FIG. 1*c*, 1*d* show a displaceable tongue with an inner flexible part that is bendable horizontally in a cross section of the tongue or along the joint. Such systems are referred to as vertical snap systems and they provide an automatic locking during the folding action.

The locking system may also be locked with a side push action such that a displaceable tongue 30 is pushed into a locked position from the long side edge when adjacent sort side edges are folded down to the sub floor. Such a side push action could be difficult to combine with a simple angling and the friction may be too strong for wide panels.

FIG. 1*e* shows a fold down system with a flexible tongue 30 that is made in one piece with the core. FIG. 1*f* shows a long edge locking system in a fold down system that is connected with angling.

Although such systems are very efficient, there is still room for improvements. Vertical snap systems are designed with the tongue on the strip panel. The reason is that an inclined sliding surface can only be formed on the fold panel when the upper edges are made without a bevel and this is generally the case. It is difficult to insert the separate tongue 30 during production into a groove 40 over a strip 6 comprising a locking element 8. The locking force is dependant on the snapping resistance. High locking force can only be accomplished with high snapping resistance when the tongue is pressed inwardly and when it snaps back into a tongue groove 40. This creates separation forces that tend to push the panels apart during folding. The locking may lose its strength if the flexibility and pressing force of the tongue decreases over time. The flexibility must be considerable and allow that a flexible tong is displaced in two directions about 1-2 mm. The material, which is used to produce such tongues, is rather expensive and glass fibres are generally used to reinforce the flexible tongue.

It would be a major advantage if the separate tongue could be fixed to the fold panel and if snapping could be eliminated in a system that locks automatically during folding.

SUMMARY

An overall objective of embodiments of the present disclosure is to provide a locking system for primarily rectangular floor panels with long and short edges installed in parallel rows, which allows that the short edges may be locked to each other automatically without a snap action that creates a locking resistance and separation forces of the short edges during folding. A specific objective is to provide a locking system with a separate displaceable tongue on the fold panel that may lock without any contact with the sharp upper edge of the strip panel and that the tongue is displaced essentially in one direction only from an inner part of a groove and outwardly.

The above objects of embodiments of the disclosure are achieved wholly or partly by locking systems and floor panels according to the independent claims. Embodiments of the disclosure are evident from the dependent claims and from the description and drawings.

A first aspect of the disclosure are building panels provided with a locking system for vertical locking of a first and a second building panel by a vertical displacement of the panels relative each other. A sidewardly open tongue groove is provided at an edge of the first building panel. A strip protrudes below the tongue groove and outwardly beyond the upper part of the edge of said first panel. A displaceable tongue is provided in a sidewardly open displacement groove at an edge of the second building panel. The displaceable tongue comprises a main body extending along the edge of the second panel and preferably a tongue locking surface, located at an upper and outer part of the displaceable tongue, configured to cooperate with a groove locking surface of the tongue groove for a vertical locking of the first and the second building panel. The displaceable tongue comprises an inner part, spaced inwardly from an upper part of an edge of said second panel, the inner part comprises a tongue pressing surface configured to cooperate with a strip pressing surface on the strip. The displaceable tongue is configured to be displaced into the tongue groove when the tongue and the strip pressing surface are displaced vertically against each other to obtain the vertical locking.

The displaceable tongue is preferably an injection-moulded tongue.

The displaceable tongue may be asymmetric and comprising a protrusion and the second panel may comprise a cavity for housing the protrusion.

The protrusion may comprise a flexible part.

The strip may be provided with a locking element that cooperates with a downwardly open locking groove formed on the second panel for locking the first and the second building panel in a horizontal direction.

The tongue pressing surface is preferably positioned on the protrusion and the strip pressing surface is preferably located on the locking element.

The strip pressing surface is most preferably located on an inclined surface of the locking element that is directed towards the edge of the first building panel.

The locking system may comprise a cavity that extends from the displacement groove to the locking groove.

The strip and the tongue pressing surfaces may be inclined against a horizontal plane with an angle of about 25 to 75 degrees.

The displacement groove may be inclined and comprise an inner part that extends downwards.

The building panels may be locked vertically by two pairs of cooperating surfaces comprising the groove locking surface and the tongue locking surface, and an upper part of the strip and a lower part of the edge of the second panel, respectively.

The groove locking surface and the tongue locking surface may be inclined against a horizontal plane.

The groove locking surface and the tongue locking surface may be inclined with an angle of about 10 to 60 degrees to a horizontal plane.

The displaceable tongue may be provided with a flexible friction element.

The displaceable tongue may comprise at least two protrusions extending from the main tongue body and each protrusion may comprise said tongue pressing surface located at an outer part of the protrusion that during locking is in contact with a locking element provided on the strip.

The building panel may be a floor panel and the outer part of the displaceable tongue is preferably in an unlocked position located in the displacement groove.

The displacement groove may extend vertically above the locking groove.

The locking groove may be located vertically below the upper part of the displacement groove.

An upper part of the locking element may be located vertically below the tongue locking surface of the displaceable tongue.

An upper part of the locking groove may be located vertically below the tongue locking surface of the displaceable tongue.

The innermost part of the displaceable tongue may be below the outermost part of such tongue.

The tongue pressing surface may be located vertically below the tongue locking surface.

An upper part of the locking element may be located in the lower half of an intermediate core of the first building panel.

The strip may be flexible such that it bends downwards during locking.

The cavity may be larger than the protrusion such that there is a space S of at least about 1-3 mm.

The displaceable tongue may be gradually inserted into the tongue groove from a tongue part, which is adjacent an installed long edge, to another tongue part adjacent a free long edge.

BRIEF DESCRIPTION OF THE DRAWINGS

The disclosure will in the following be described in connection to exemplary embodiments and in greater detail with reference to the appended exemplary drawings, wherein:

FIGS. 1*a-f* illustrate locking systems according to known technology.

DESCRIPTION OF EMBODIMENTS OF THE DISCLOSURE

Figure 2A:
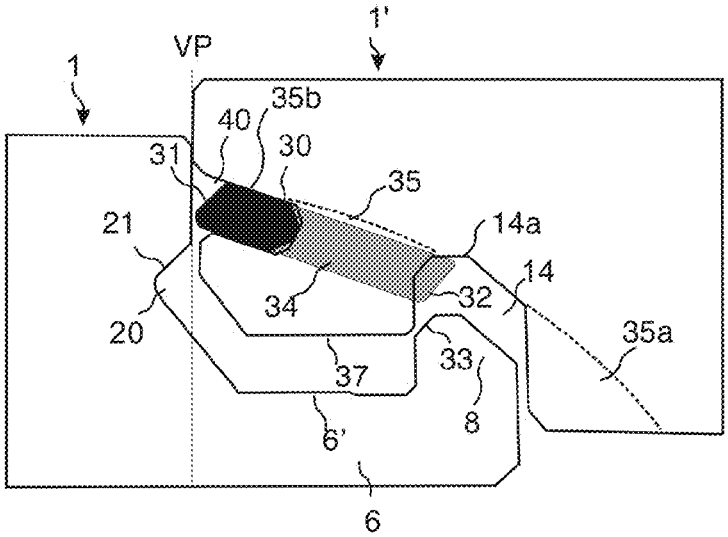
FIGS. 2*a-d* illustrate a short edge locking system according to an embodiment of the disclosure.
Figure 2B:
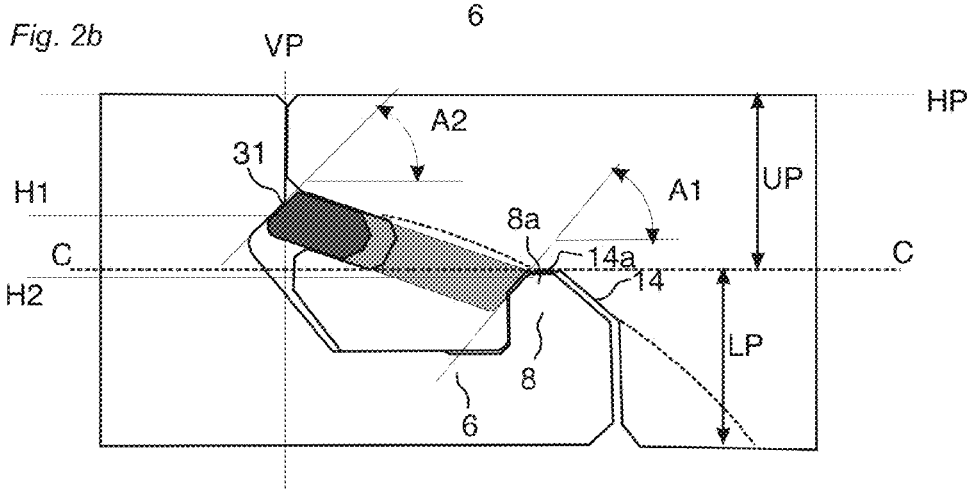
Figure 2C:
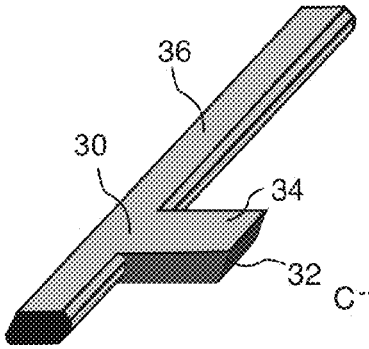

To facilitate understanding, several locking systems in the figures are shown schematically. It should be emphasised that improved or different functions may be achieved using combinations of the preferred embodiments.

All embodiments may be used separately or in combinations. Angles, dimensions, rounded parts, spaces between surfaces etc are only examples and may be adjusted within the basic principles of the disclosure.

FIGS. 2*a*-2*d* show a first preferred embodiment of a short edge locking system provided with a flexible and displaceable tongue 30 in an edge of a second panel 1' inserted in a displacement groove 40 and extending along the edge of the second panel. The displaceable tongue 30 has a tongue locking surface 31 located at an upper and outer part that cooperates with a groove locking surface 21 located at an inner and upper part of a tongue groove 20 formed in an adjacent edge of a first panel 1. The locking surfaces lock the panels in a first vertical direction. The locking surfaces are preferably inclined with an angle A2 that is about 10-60 degrees. The displacement groove is preferably also inclined and the outer part is closer to the panel surface than an inner part.

The first panel 1 comprises a protruding strip 6 that extends outwardly beyond a vertical plane VP. The strip comprises a locking element 8. The second panel 1' comprises a locking groove 14 that cooperates with the locking element 8 and locks the panels in a horizontal direction. The strip 6 has an upper part 6', which is in contact with a lower part 37 of the adjacent edge and locks the panels in a second vertical direction.

The displaceable tongue 30 comprises a protrusion 34 extending from a main tongue body 36. The second panel 1' comprises at least one cavity 35 for housing the protrusion. The cavity extends from the displacement groove to the locking groove 14.

The cavity may be formed by a screw cutter or by displaceable saw blades.

The protrusion comprises a tongue pressing surface 32 which cooperates with a strip pressing surface 33 on the locking element. The strip pressing surface 33 and the tongue pressing surface 32 are inclined with an angle A1 which is preferably 25-75 degrees against a horizontal plane HP.

The displaceable tongue is displaced essentially in one direction towards the tongue groove 20 when the inclined pressing surfaces are sliding against each other during the vertical displacement of the adjacent edges. The tongue may be locked with a strong pressure against the groove locking surface 21 and the locking element 8 prevents the tongue from sliding back into the displacement groove.

Figure 2D:
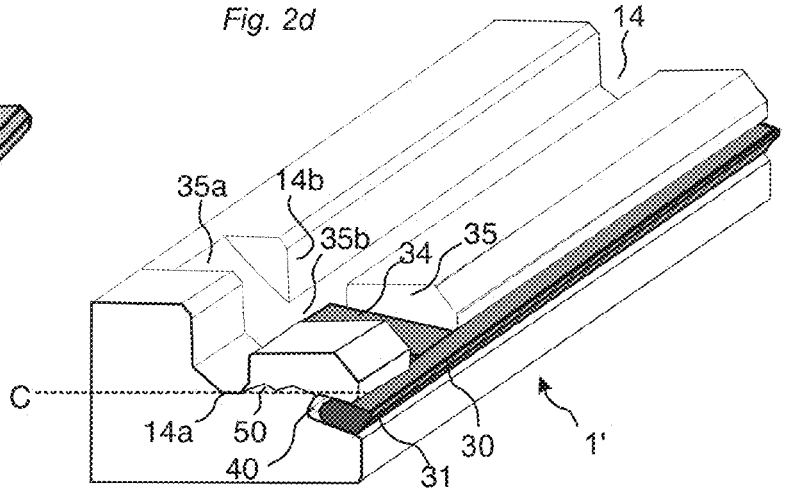
Figure 3A:
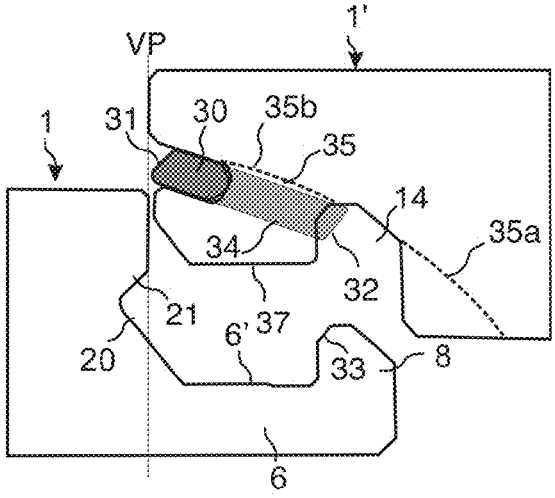
FIGS. 3*a*-3*d* illustrate a short edge locking system according to preferred embodiments of the disclosure.
Figure 3B:
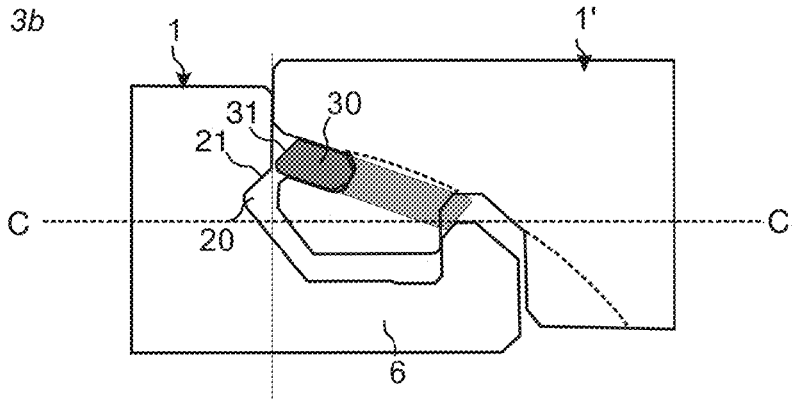
Figure 3C:
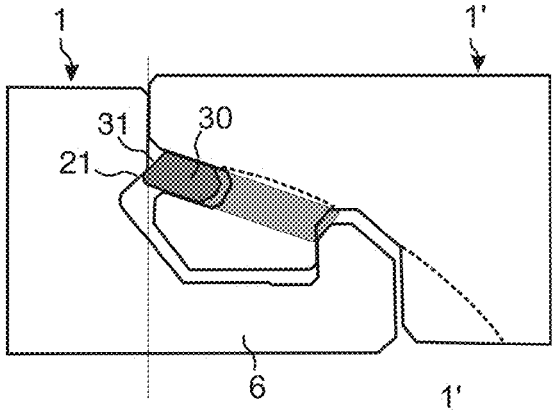
Figure 3D:
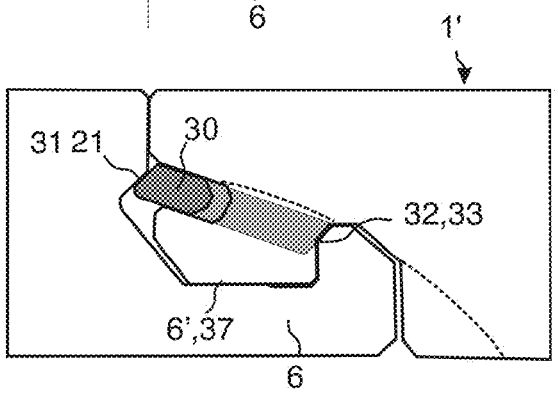

One major problem related to a "press lock system" as described above is the risk that the panel may split with a crack 50 between the displacement groove 40 and the locking groove 14 as shown in FIG. 2*d*. Therefore it is preferable that the upper parts of the locking groove 14*a* and the locking element 8*a* are made in the lower part of the floor panel, preferably below the center line C that divides the floor panel in two equal parts, one upper part UP and one lower part LP. It is also preferable that the tongue pressing surface 32 is located vertically below the tongue locking surface 31. The tongue pressing surface and the tongue locking surface are preferably offset vertically and are preferably located on different horizontal planes H2, H1. It is also preferred that an upper part of the locking element 8*a* and/or an upper part of the locking groove 14*a* are located vertically below the tongue locking surface 31. The innermost part of the displaceable tongue 30 is preferably located below the outermost part of such tongue.

The cavities 35 are preferably formed by rotating saw blades and comprise preferably an upper rounded part with an outer part 35*b* that is located above an inner part 35*a* as shown in FIG. 2*d*. The cavity is preferably formed such that it intersects the inner part 14*b* of the locking groove 14.

FIGS. 3*a*-3*d* show the locking function during the vertical displacement of the second panel 1' against the first panel 1. The displaceable tongue 30 is gradually pressed into the tongue groove 20 by the cooperating pressing surfaces 32,33 and the panels are locked vertically with two pairs of cooperating locking surfaces, the tongue locking surface 31 and the groove locking surface 21 and an upper part 6' of the strip 6 and a lower part 37 of the adjacent edge 1'.

Figure 4A:
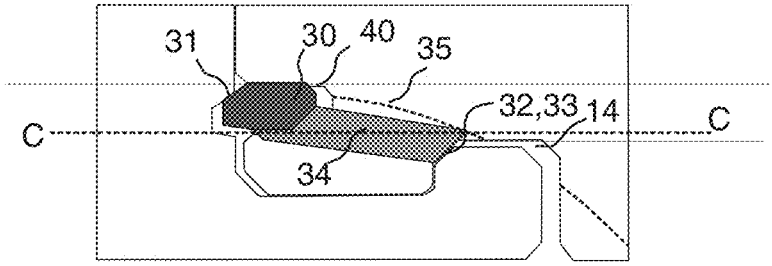
FIGS. 4*a-e* illustrate preferred embodiments of short edge locking systems.
Figure 4B:
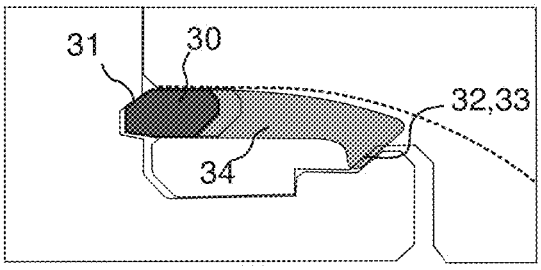
Figure 4C:
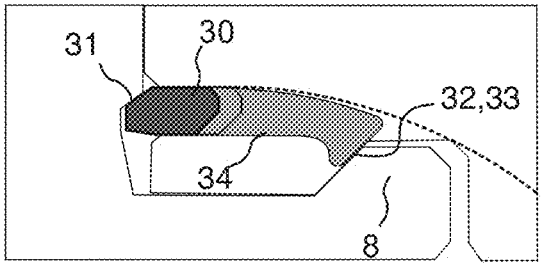
Figure 4D:
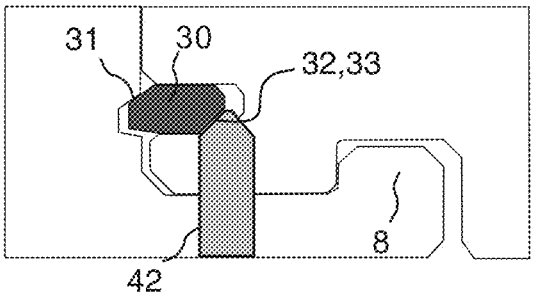
Figure 4E:
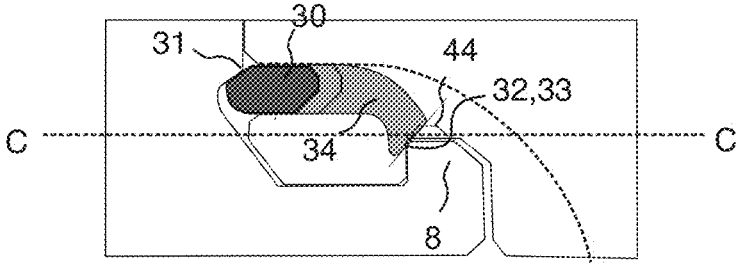

FIGS. 4*a*-4*e* show different embodiments. FIG. 4*a* shows a displaceable tongue 30 with a protrusion 34 located under the main tongue body. The locking groove 14 is located vertically under an upper part of the displacement groove 40. FIG. 4*b* shows a tongue pressing surface 32 that locks against a strip pressing surface that is not active in the horizontal locking. FIG. 4*c* shows that the same locking surface 33 on the locking element 8 may be used as a pressing surface and as a locking surface for the horizontal locking. FIG. 4*d* shows that the strip pressing surface may be formed on a separate pushing rod 42. FIG. 4*e* shows a protrusion 34 that comprises a curved cross section and a locking element that comprises an upper part 44 formed as local protrusion that protrudes above the inner part of the locking groove 14 and into the cavities 35.

Figure 5A:
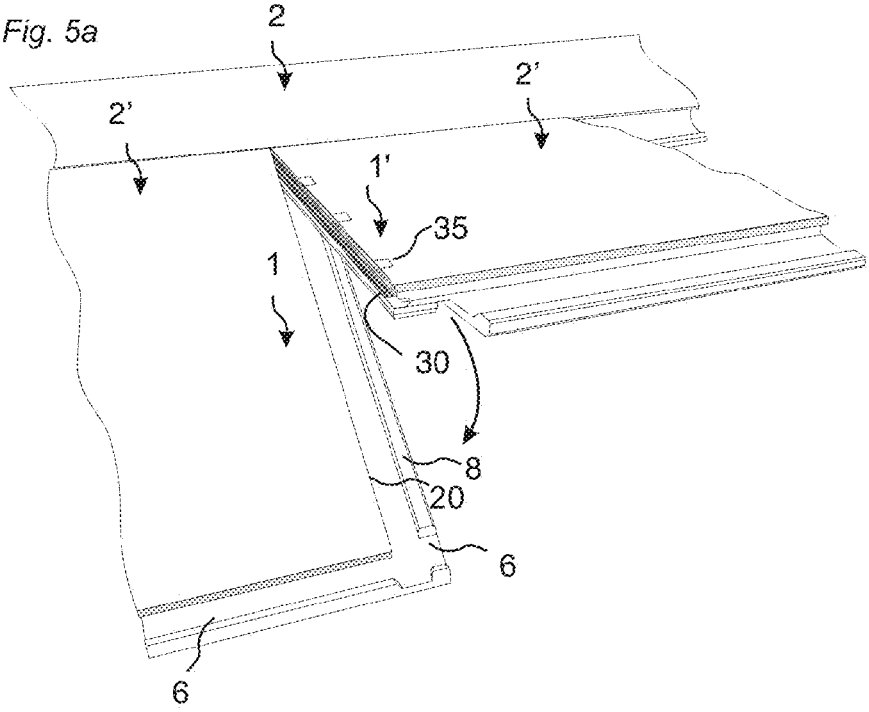
FIGS. 5*a-e* illustrate vertical folding of three panels according to an embodiment of the disclosure.
Figure 5B:
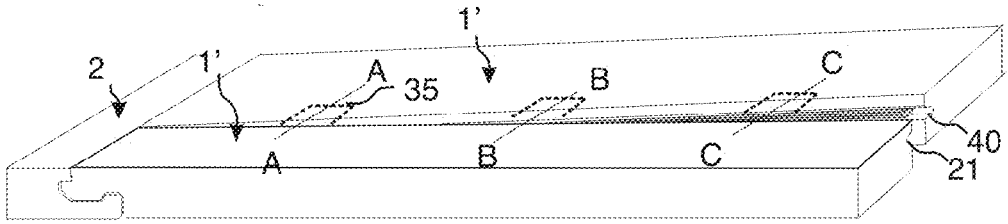
Figure 5C:
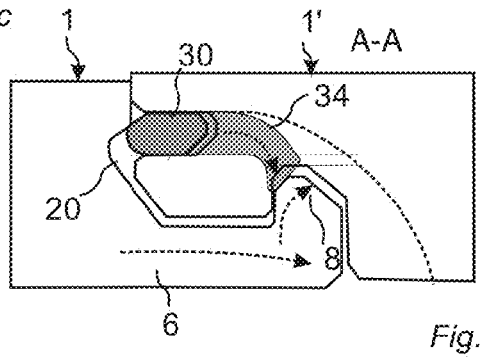
Figure 5D:
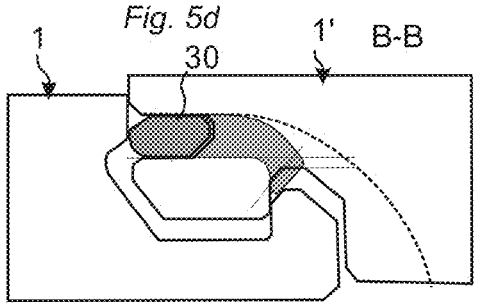
Figure 5E:
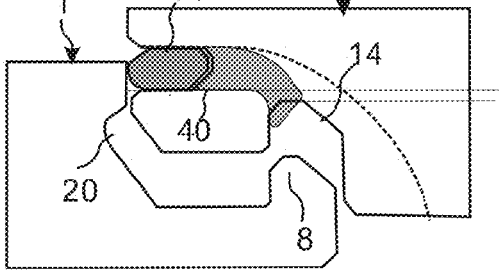

FIGS. 5*a*-5*e* show vertical folding of three panels wherein the long edges 2,2' are connected with angling and the short edges 1, 1' with a scissor like motion that combines angling and vertical displacement. FIG. 5*b* shows that the displaceable tongue is gradually inserted into the tongue groove 20 from one part of the edges that is adjacent to the installed long edge 2 to the other free long edge. FIG. 5*c* shows the tongue in the cross section A-A and FIGS. 5*d*, 5*e* show the tongue position in the cross sections B-B, and C-C. The strip 6 and the locking element 8 are in this embodiment designed such that they bend backwards during locking and this facilitates locking since the necessary flexibility may be provided partly or completely with such strip bending. The locking groove is positioned vertically under the lower part of the displacement groove 40.

Figure 6A:
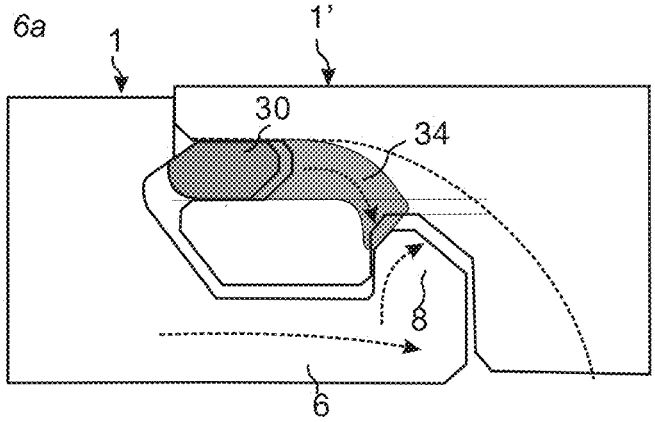
FIGS. 6*a-e* illustrate the flexibility of the locking systems during locking and preferred embodiments of displaceable tongues.

FIG. 6*a* shows that the locking system may be formed such that several parts are flexible for example the protrusion 34, the locking strip 6 and the locking element 8. This flexibility may be used to reduce or eliminate production tolerances and to facilitate an easy and strong locking. FIG. 6*a* shows that the strip 6 may be bent downwards and the locking element 8 may be bent downwards and outwardly. Such a strip bending may facilitate locking that may even be accomplished with a displaceable tongue that comprises a limited flexibility such as a tongue that essentially comprises wood fibre material. A locking can be accomplished with a flexibility where a part of the displaceable tongue 30 is bended or compressed marginally for example only about 0.1-1.0 mm in the horizontal direction.

Figure 6B:
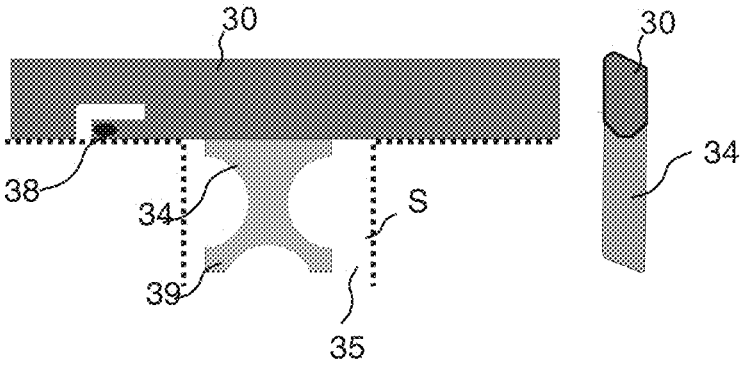
Figure 6C:
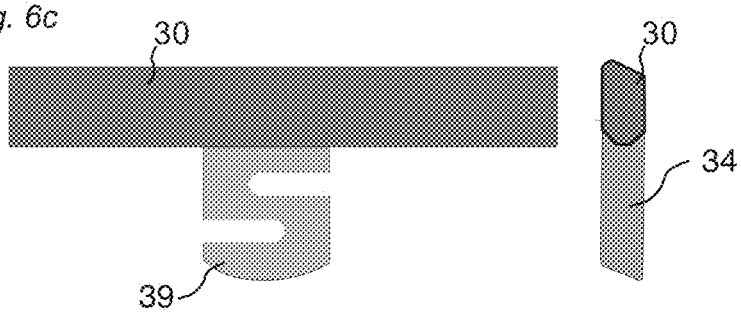

FIGS. 6*b* and 6*c* show embodiments of the tongue. The displaceable tongue 30 may be fixed into the displaceable groove with a friction connection 38. The protrusion 34 may comprise flexible parts 39 that create a pre tension against the tongue groove 20. The cavity 35 may be considerably larger than the protrusion and preferably there is a space S that may be about 1-3 mm.

Figure 6D:
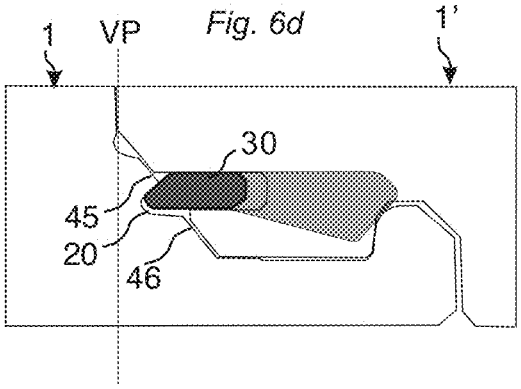

FIG. 6*d* shows a locking system with a sliding surface 45 that protrudes beyond a vertical plane VP. The tongue groove 20 is preferably formed on an inclined edge surface 46. Such an embodiment offers the advantages that the displaceable tongue 30 may be pressed inwardly and the conventional two-way snapping action may be combined with a one way pressing motion that may be used to create the final locking.

Figure 6E:
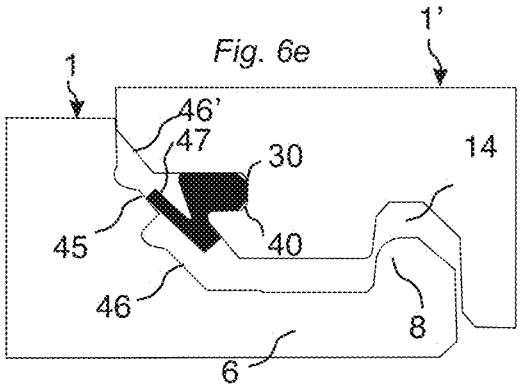

FIG. 6*e* shows a separate tongue 30, located in a sideway open groove 40 on the second panel 1', comprising an upwardly extending snap tab 47 that cooperates with a downwardly extending sliding surface 45 that is located on the first panel 1 and that protrudes beyond the upper edge and the vertical plane VP. The second panel 1' comprises preferably an inclined edge surface 46' located above and and/or below the tongue 30. An easy snapping may be obtained even with panels that have straight and sharp upper adjacent edges. The snap tab may be replaced with a displaceable tongue that comprises flexible snapping protrusions along its length. The locking system shown in FIG. 1*d* may also be adjusted such that it comprises inclined edge surfaces and such a design may be used to increase the strength of the joint.

The locking system according to the disclosure may also be formed without a locking grove 14 and a locking element 8 such that it only locks the edges in a vertical direction. The locking element 8 may be replaced with local protrusions that extend upwards from a strip 6 and are in locked position located in the cavities. The short edges may be locked horizontally by friction between the long edges.

All locking systems may be designed such that they can be unlocked with angling and/or sliding along the edges.

Figure 7A:
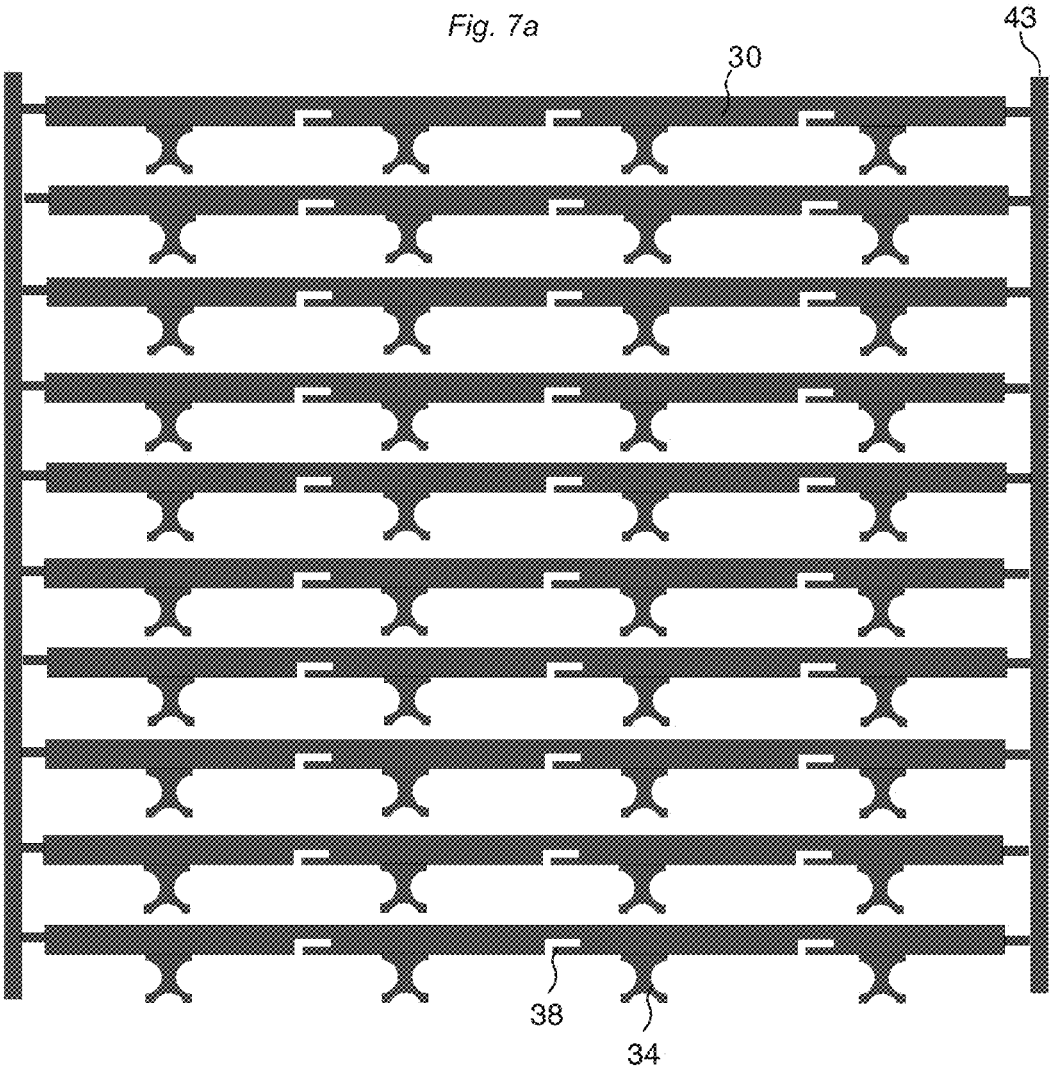
FIGS. 7*a-b* illustrate tongue blanks according to embodiments of the disclosure comprising several displaceable tongues.
Figure 7B:
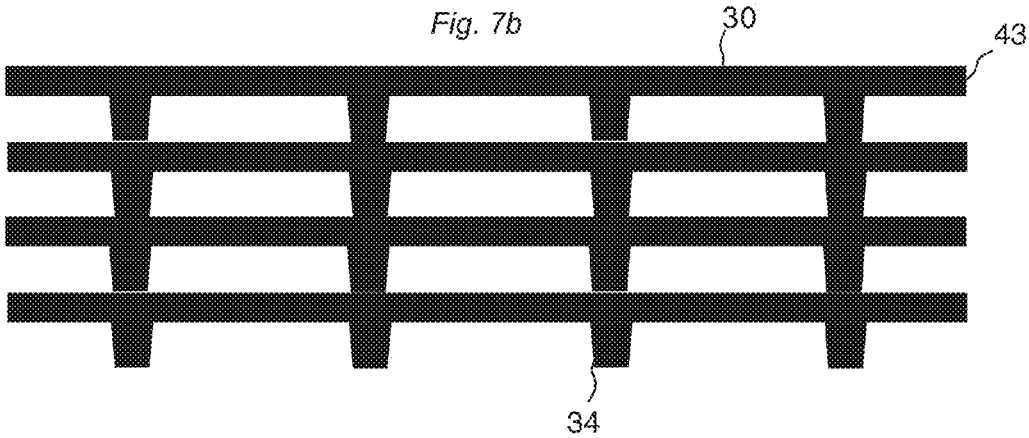

FIG. 7*a*, 7*b* show a tongue blank 43 that comprise several displaceable tongues that are preferably asymmetric along the tongue length. FIG. 7*a* shows injection-moulded tongues 30 and FIG. 7*b* shows displaceable tongues 30 made of a wood based material that is preferably machined and punched.

The cavities 35 that are preferably formed by rotating saw blades comprises an upper part that is rounded and may comprise an inner part that is located below an outer part. The locking system may be partly or completely formed by carving tools.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

The invention claimed is:

1. Building panels provided with a locking system for vertical locking of a first building panel and a second building panel by a vertical displacement of the panels relative each other, the panels comprising:

a sidewardly open tongue groove provided at an edge of the first building panel, and a strip protruding below the tongue groove and outwardly beyond an upper part of the edge of said first building panel, the strip comprising a locking element configured to cooperate with a downwardly open locking groove formed on the second building panel, for locking of the first and the second building panels in a horizontal direction;

a displaceable tongue provided in a sidewardly open displacement groove, the sidewardly open displacement groove in an edge of the second building panel and the sidewardly open displacement groove extends vertically above a top of the locking groove, the displaceable tongue comprises a main body extending along the edge of the second panel and a tongue locking surface located at an upper and outer part of the tongue, the tongue locking surface cooperating for vertical locking with a groove locking surface of the tongue groove;

the displaceable tongue comprises an inner part spaced inwardly from an upper part of the edge of said second panel;

the inner part comprises a tongue pressing surface configured to cooperate with a strip pressing surface on the strip, such that the displaceable tongue is displaced into the tongue groove when the tongue pressing surface and the strip pressing surface are displaced vertically against each other to obtain a locking of the first and the second building panel in a vertical direction.

2. The building panels as claimed in claim 1, wherein said displaceable tongue is asymmetric and comprises a protrusion and the second panel comprises a cavity for housing the protrusion.

3. The building panels as claimed in claim 2, wherein the protrusion comprises a part that is flexible.

4. The building panels as claimed in claim 2, wherein the cavity is larger than the protrusion such that there is a space of at least about 1-3 mm between the protrusion and a boundary of the cavity when the protrusion is housed in the cavity.

5. The building panels as claimed in claim 1, wherein the tongue pressing surface is provided on the protrusion and the strip pressing surface is provided on the locking element.

6. The building panels as claimed in claim 5, wherein the strip pressing surface is provided at an inclined surface of the locking element directed towards the first edge.

7. The building panels as claimed in claim 1, wherein the strip pressing surface is provided at an upper part of the locking element.

8. The building panels as claimed in claim 2, wherein the cavity extends from the displacement groove to the locking groove.

9. The building panels as claimed in claim 1, wherein an upper part of the locking element is located vertically below the tongue locking surface of the displaceable tongue when the first and the second building panels are locked in a vertical direction.

10. Building panels provided with a locking system for vertical locking of a first building panel and a second building panel by a vertical displacement of the panels relative each other, the panels comprising:

a sidewardly open tongue groove provided at an edge of the first building panel, and a strip protruding below the tongue groove and outwardly beyond an upper part of the edge of said first building panel, the strip comprising a locking element configured to cooperate with a downwardly open locking groove formed on the second building panel, for locking of the first and the second building panels in a horizontal direction;

a displaceable tongue provided in a sidewardly open displacement groove, the sidewardly open displacement groove in an edge of the second building panel, the displaceable tongue comprises a main body extending along the edge of the second panel and a tongue locking surface located at an upper and outer part of the tongue, the tongue locking surface cooperating for vertical locking with a groove locking surface of the tongue groove;

the displaceable tongue comprises an inner part spaced inwardly from an upper part of the edge of said second panel;

the inner part comprises a tongue pressing surface configured to cooperate with a strip pressing surface on the strip, such that the displaceable tongue is displaced into the tongue groove when the tongue pressing surface and the strip pressing surface are displaced vertically against each other to obtain a locking of the first and the second building panel in a vertical direction, wherein an uppermost part of at least a portion of the locking groove is located vertically below the tongue locking surface of the displaceable tongue.

11. The building panels as claimed in claim 1, wherein an upper most part of the locking element is located in a lower half of an intermediate core of the first building panel.

12. The building panels as claimed in claim 1, wherein the tongue pressing surface and the strip pressing surface are inclined relative to a horizontal plane with an angle of about 25 to 75 degrees.

13. The building panels as claimed in claim 1, wherein the displacement groove is inclined and comprises an inner part that extends downwards.

14. The building panels as claimed in claim 1, wherein the first and the second building panels are locked vertically by a first and a second pair of cooperating surfaces, the first pair comprises the tongue locking surface and the groove locking surface, the second pair comprises an upper part of the strip and a lower part of the edge of the second panel.

15. The building panels as claimed in claim 1, wherein said groove locking surface and said tongue locking surface are inclined relative to a horizontal plane.

16. The building panels as claimed in claim 1, wherein the groove locking surface and the tongue locking surface are inclined relative to a horizontal plane with an angle of about 10 to about 60 degrees.

17. The building panels as claimed in claim 1, wherein the displaceable tongue comprises a flexible friction element.

18. The building panels as claimed in claim 1, wherein the displaceable tongue comprises at least two protrusions extending from the main body, wherein each protrusion comprises said tongue pressing surface at an outer part of the protrusion, wherein each tongue pressing surface is configured to be in contact during locking with the locking element provided on the strip.

19. The building panels as claimed in claim 1, wherein the building panels are floor panels.

20. The building panels as claimed in claim 1, wherein the upper and outer part of the displaceable tongue in an unlocked position is located in the displacement groove.

21. The building panels as claimed in claim 1, wherein the innermost part of the displaceable tongue is below the outermost part of the displaceable tongue.

22. Building panels provided with a locking system for vertical locking of a first building panel and a second building panel by a vertical displacement of the panels relative each other, the panels comprising:

a sidewardly open tongue groove provided at an edge of the first building panel, and a strip protruding below the tongue groove and outwardly beyond an upper part of the edge of said first building panel;

a displaceable tongue provided in a sidewardly open displacement groove, the sidewardly open displacement groove in an edge of the second building panel, the displaceable tongue comprises a main body extending along the edge of the second panel and a tongue locking surface located at an upper and outer part of the tongue, the tongue locking surface cooperating for vertical locking with a groove locking surface of the tongue groove;

the displaceable tongue comprises an inner part spaced inwardly from an upper part of the edge of said second panel;

the inner part comprises a tongue pressing surface configured to cooperate with a strip pressing surface on the strip, such that the displaceable tongue is displaced into the tongue groove when the tongue pressing surface and the strip pressing surface are displaced vertically against each other to obtain a locking of the first and the second building panel in a vertical direction, wherein the entire tongue pressing surface is located vertically below the tongue locking surface.

23. The building panels as claimed in claim 1, wherein the strip is flexible such that it bends downwards during locking.

24. The building panels as claimed in claim 1, wherein the displaceable tongue during locking is gradually inserted into the tongue groove from one part of the tongue, which is adjacent to an installed long edge of an adjacent panel, to another part of the tongue, which is adjacent to a free long edge of the first panel.

25. The building panels as claimed in claim 1, wherein the displaceable tongue is an injection-moulded tongue.

26. Building panels provided with a locking system for vertical locking of a first building panel and a second building panel by a vertical displacement of the panels relative each other, the panels comprising:

a sidewardly open tongue groove provided at an edge of the first building panel, and a strip protruding below the tongue groove and outwardly beyond an upper part of the edge of said first building panel, the strip comprising a locking element configured to cooperate with a downwardly open locking groove formed on the second panel, for locking of the first and the second building panels in a horizontal direction;

a displaceable tongue provided in a sidewardly open displacement groove, the sidewardly open displacement groove in an edge of the second building panel and the sidewardly open displacement groove extends vertically above a top of the locking groove, the displaceable tongue comprises a main body extending along the edge of the second panel and a tongue locking surface located at an upper and outer part of the tongue, the tongue locking surface contacting a groove locking surface of the tongue groove for vertical locking; the displaceable tongue comprises an inner part spaced inwardly from an upper part of the edge of said second panel;

the inner part comprises a tongue pressing surface configured to cooperate with a strip pressing surface on the strip, such that the displaceable tongue is displaced into the tongue groove when the tongue pressing surface and the strip pressing surface are displaced vertically against each other to obtain a locking of the first and the second building panel in a vertical direction.

27. The building panels as claimed in claim 1, wherein the displaceable tongue further comprises a protrusion and the second panel comprises a cavity for housing the protrusion, and the cavity extends farther from a vertical joint plane than a surface of the locking groove that faces the vertical joint plane.

* * * * *